US007811096B2

(12) United States Patent
Takagi

(10) Patent No.: US 7,811,096 B2
(45) Date of Patent: Oct. 12, 2010

(54) IC SOCKET SUITABLE FOR BGA/LGA HYBRID PACKAGE

(75) Inventor: Naohiro Takagi, Kanagawa (JP)

(73) Assignee: NEC Electronics Corporation, Kanagawa (JP)

( * ) Notice: Subject to any disclaimer, the term of this patent is extended or adjusted under 35 U.S.C. 154(b) by 320 days.

(21) Appl. No.: 11/747,800

(22) Filed: May 11, 2007

(65) Prior Publication Data

US 2007/0264846 A1 Nov. 15, 2007

(30) Foreign Application Priority Data

May 15, 2006 (JP) ..... 2006-135188

(51) Int. Cl.
*H01R 12/00* (2006.01)

(52) U.S. Cl. ..... 439/71; 439/700; 324/761

(58) Field of Classification Search ..... 439/71, 439/73, 68, 700; 324/761
See application file for complete search history.

(56) References Cited

U.S. PATENT DOCUMENTS 4,620,761 A * 11/1986 Smith et al. ..... 439/372
5,990,697 A * 11/1999 Kazama ..... 324/761
6,354,844 B1 * 3/2002 Coico et al. ..... 439/66
7,053,496 B2 * 5/2006 Stone ..... 257/798
7,220,134 B2 * 5/2007 Goodman et al. ..... 439/70
2002/0149121 A1 * 10/2002 Shikano et al. ..... 257/787

FOREIGN PATENT DOCUMENTS

JP 11-86992 A 3/1999
JP 2001-196144 A 7/2001
JP 2002-246131 A 8/2002
JP 2003-123923 A 4/2003

* cited by examiner

*Primary Examiner*—Xuong M Chung-Trans
(74) *Attorney, Agent, or Firm*—Sughrue Mion, PLLC

(57) ABSTRACT

An IC socket is provided with first and second contact pins and a socket body supporting said first and second contact pins. The first contact pin is used to establish a connection with a first terminal of a semiconductor package, while the second contact pin is used to establish a connection with a second terminal of said semiconductor package. The first and second terminals have different heights from a mount face of the semiconductor package.

10 Claims, 10 Drawing Sheets

IC SOCKET SUITABLE FOR BGA/LGA HYBRID PACKAGE

BACKGROUND OF THE INVENTION

1. Field of the Invention

The present invention relates to an IC socket for establishing electrical connections with a semiconductor package, suitably used in LSI tests, such as function tests and burn-in tests.

2. Description of Related Art

The progress in integration degree and function of LSIs (Large Scale Integrated Circuit) due to the advance in the semiconductor technology is accompanied by the fact that an increasing number of external terminals are required for signal inputs and outputs of an LSI. Additionally, an increasing number of terminals are required for testing an LSI due to the recent tendency that functions integrated within the LSI have become more complex. It is desirable that the number of terminals used only for LSI tests should be as small as possible since such terminals are not used by users in the actual use. Although various efforts have been made to decrease the number of test terminals, including commonly using terminals for test and actual use and serially inputting and outputting test signals, the number of test terminals is currently on the increase.

The number of terminals mountable onto an LSI package is physically limited, and this makes it difficult to connect all the contact pads of an LSI chip with external terminals of an LSI package. This tendency is particularly remarkable for SIPs (System In Package). Therefore, test terminals are not given high priority in providing connections with external terminals of the LSI package, since test terminals are not necessary in the actual use of the LSI; however, the lack of test terminals is undesirable for improving the reliability of LSIs.

The inventor considers that one approach for providing a desired number of test terminals is to use an IC package including both of a ball grid array (BGA) and a land grid array (LGA); such IC package is referred to as BGA/LGA hybrid package, hereinafter. The ball grid array, composed of an array of solder balls, is used to establish physical and electrical connection with a printed circuit board, and the land grid array, composed of an array of lands, is only used in the LSI test. Such package structure allows providing a desired number of test terminals for an IC package with a reduced package size.

One issue is to establish electrical connections with both of the ball grid array and land grid array. In general, IC sockets are used for establishing electrical connections with BGA packages or LGA packages (BGA/LGA packages) in conducting functional tests and burn-in tests of LSIs. A variety of IC sockets have been developed to provide secure electrical connections between LSIs and terminals of IC sockets without damaging the LSIs. For instance, Japanese Laid Open Patent Application No. Jp-A2003-123923 (hereinafter, the '923 application) and the corresponding U.S. Patent Application Publication No. 2005/070134 disclose an IC socket for testing a BGA package. The disclosed IC socket is composed of a socket body and a plurality of contacts to be connected with solder balls of a BGA package. The socket body has a plurality of mounting-holes into which the contacts are inserted. Each of the mounting holes has a through hole which is penetrated in the height direction of the body, and a support hole for supporting the contact. Each of the contacts has an upright piece extending through the through-hole and a support piece extending from the upright piece to be inserted into the through-hole from a top surface side of the socket body. A contact portion to be brought into contact with the solder ball is formed at a tip end portion of the upright piece and the support piece is extending from a proximal end portion of the upright piece.

Additionally, Japanese Laid Open Patent Applications No. Jp-A2002-246131 (hereinafter, the '131 application) and Jp-A Heisei 11-86992 (hereinafter, the '992 application) disclose IC sockets provided with plungers to be connected with solder balls, the plungers being biased against solder balls with coil springs. Specifically, the '131 application discloses an IC socket in which contact pins are disposed through a socket body to provide electrical connections between solder balls of a BGA package and a printed circuit board. Each contact pin includes first and second plungers. The first plunger is electrically connected to one of the solder balls and the second plunger is electrically connected to a terminal provided on the printed circuit. Between the first plunger and the second plunger provided are a cylindrical body and an elastic member. The cylindrical body is struck against the first plunger on one end, and slidably accommodates the second plunger at the other end. An elastic member is disposed between the cylindrical body and the second plunger, and the first and second plungers are biased away from each other by the elastic member.

The '992 application discloses a spring connector used in an IC socket which provides electrical connections between a solder ball of a BGA package and a printed circuit board. The spring connector is provided with a cylindrical body and a plunger. One end of the cylindrical body is closed with a bottom plate, and a protrusion formed of solder is provided on the bottom plate. The cylindrical body is made of conductive material. The other end of the cylindrical body is open, and the plunger is slidably inserted into the cylindrical body through the opening. A spring is provided in the cylindrical body, biasing the plunger toward the solder ball of the BGA packages.

Furthermore, Japanese Laid Open Patent Application Jp-A2001-196144 (hereinafter, referred to as the '144 application) discloses an IC socket for an LGA package. The IC socket disclosed in the '144 application is provided with a housing plate with a concave portion, and an array of terminals provided in the concave portion. The terminals are arranged at the positions corresponding to lands of the land grid array package. Each of the terminals has a bent spring plate and a pair of side plates. The spring plate is allowed to expand and shrink in the thickness direction of the housing plate. When the spring plate is expanded, the upper end of the spring plate protrudes from the surface of the concave portion of the housing plate. The side plates are provided to sandwich the spring plate and to extend in the thickness direction of the housing plate. The spring plate is provided with protrusions which are slidably contacted with the side plates.

Nevertheless, the IC socket structures disclosed in the above-mentioned applications are not adapted to the BGA/LGA hybrid package. The contact points of the respective external terminals of the IC socket structures disclosed in the above-mentioned applications are coplanar on the same plane; however, such structures are not preferable for the BGA/LGA hybrid package. In the BGA/LGA hybrid package, the contact points of the ball grid array are not coplanar with those of the land grid array. The use of any of the IC socket structures disclosed in the above-mentioned applications for establishing electrical connections with a BGA/LGA hybrid package results in poor electrical connections or excessive contact pressure.

SUMMARY

In one embodiment, an IC socket is provided with first and second contact pins and a socket body supporting said first and second contact pins. The first contact pin is used to establish a connection with a first terminal of a semiconductor package, while the second contact pin is used to establish a connection with a second terminal of said semiconductor package. The first and second terminals have different heights from a mount face of the semiconductor package.

BRIEF DESCRIPTION OF THE DRAWINGS

The above and other objects, advantages and features of the present invention will be more apparent from the following description of certain preferred embodiments taken in conjunction with the accompanying drawings, in which.

DETAILED DESCRIPTION OF PREFERRED EMBODIMENTS

Figure 1A:
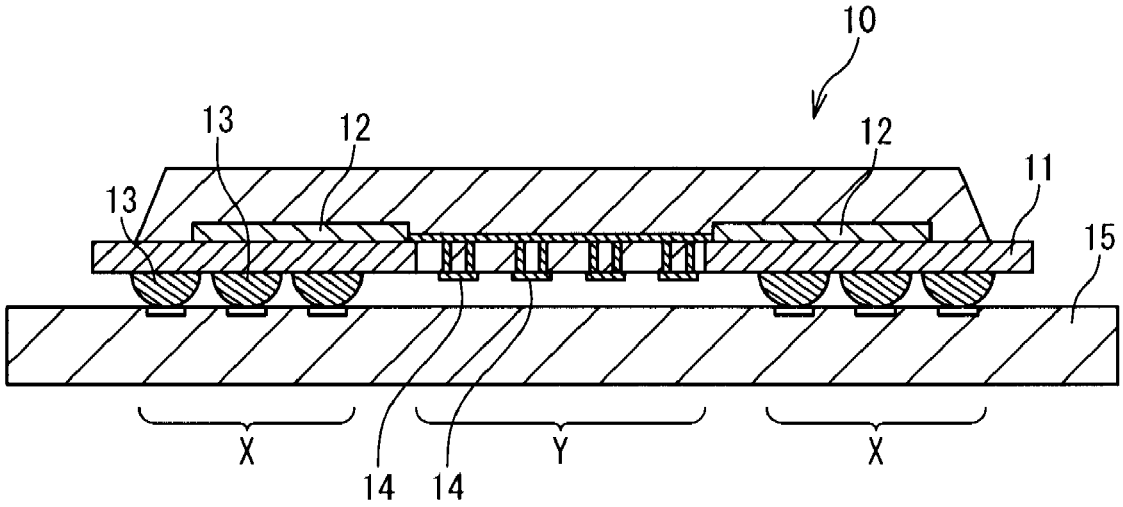
FIG. 1A is a section view illustrating an exemplary structure of a BGA/LGA hybrid package.
Figure 1B:
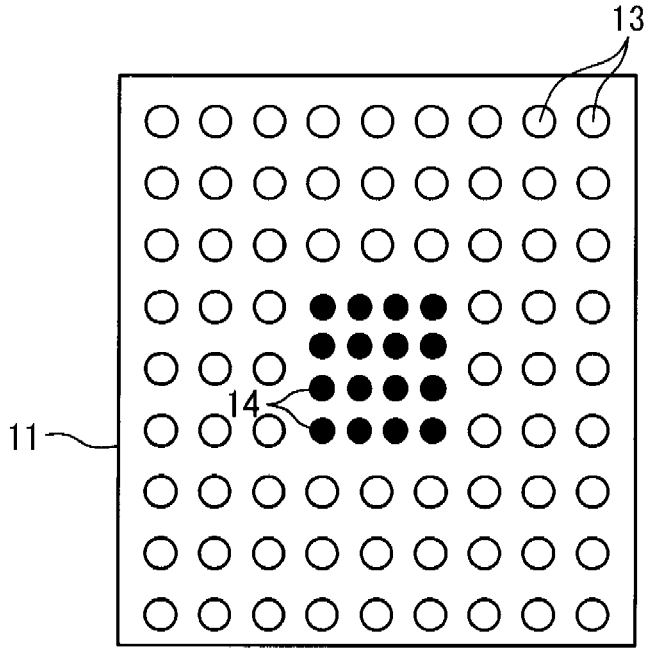
FIG. 1B is a plan view illustrating the exemplary structure of the BGA/LGA hybrid package.
Figure 2:
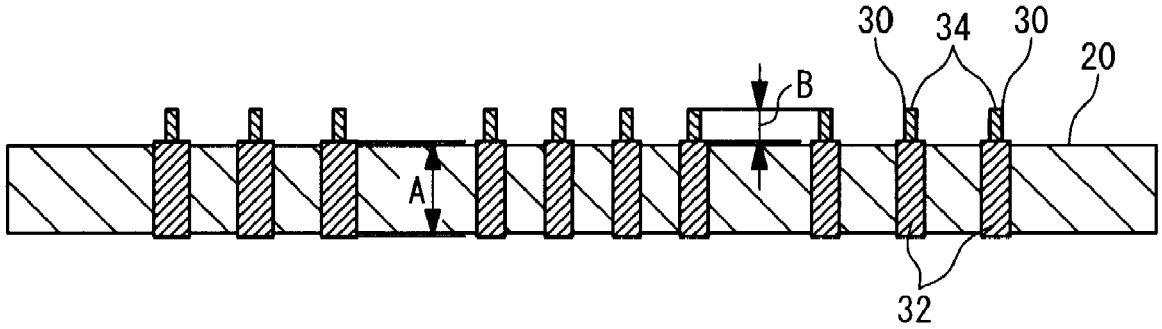
FIG. 2 is a view showing an exemplary structure of an IC socket used for testing a conventional BGA/LGA package.
Figure 3:
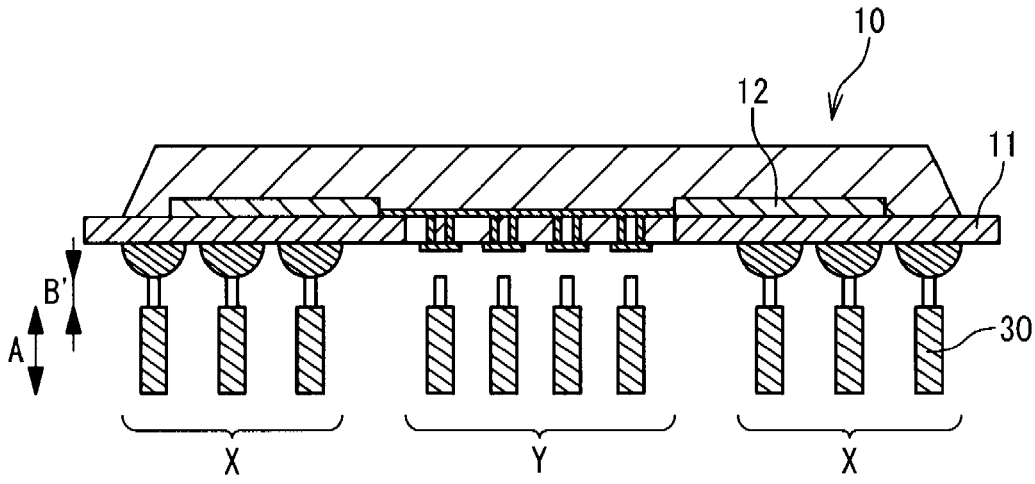
FIG. 3 illustrates the structure in which the IC socket shown in FIG. 2 is in contact with the BGA/LGA hybrid package shown in FIG. 1 to establish electrical connections.

Before describing preferred embodiments of the present invention, a detailed description is given of an exemplary structure of the BGA/LGA hybrid package and the testing thereof with reference to FIGS. 1 to 3, in order to facilitate the understanding of the present invention.

FIG. 1 illustrates an exemplary structure of a BGA/LGA hybrid package, which is denoted by the numeral 10. The BGA/LGA hybrid package 10 includes a substrate 11 and a pair of LST dies 12 provided on an upper face of the substrate 11. Provided on the rear surface (the mount face) of the substrate 11 are solder balls 13 which function as external terminals to be attached to a printed circuit board 15; the portion of the BGA/LGA hybrid package 10 in which the solder balls 13 are arrayed is referred to as the BGA portion and denoted by the numeral X in FIG. 1A. Additionally, lands 14, which functions as test terminals, are arrayed on the rear surface of the substrate 11; the portion of the BGA/LGA hybrid package 10 in which the lands 14 are arrayed is referred to as the LGA portion and denoted by the numeral Y in FIG. 1A. As shown in FIG. 1B, the array of the lands 14 is surrounded by the array of the solder balls 13. The array of the solder balls 13 is positioned in the BGA portion X in FIG. 1A, and the array of the lands 14 is positioned in the LGA portion Y in FIG. 1A.

The array of the solder balls 13 are used to establish physical and electrical connections with a printed circuit board 15 in the actual use, while the array of lands 14 is used only in the LSI test; the lands 14 in the LGA portion are not connected with the printed circuit board 15 in the actual use.

One issue is to establish electrical connections with the solder balls 13 and the lands 14 in testing the BGA/LGA hybrid package 10. IC sockets used for testing conventional BGA/LGA packages are not suitable for testing BGA/LGA hybrid packages. FIG. 2 illustrates a typical structure of an IC socket used for testing a conventional BGA/LGA package. An IC socket used for testing a BGA/LGA package is typically provided with a socket body 20 and a plurality of contact pins 30. The contact pins 30 each include a barrel member 32 and a plunger member 34. Provided within each barrel member 32 is an elastic member, typically a coil spring, for biasing the plunger member 34 towards a BGA/LGA package to be tested.

When a conventional BGA/LGA package is tested, the BGA/LGA package is placed on the contact pins 30 and desired pressure is applied onto the BGA/LGA package to establish connections between external terminals of the BGA/LGA package and the plunger members 34. The biasing members within the barrel members 32 allow the plunger members 34 to probe the external terminals of the BGA/LGA package with appropriate contact pressure.

It should be noted that positions of the external terminals of a conventional BGA/LGA package are coplanar on the same plane. Therefore, an IC socket for testing a BGA/LGA package is typically structured so that the plunger members 34 protrude from the barrel members 32 with the same protruding length, that the barrel members 32 have the same length, and that the biasing members within the barrel members 32 have the same elastic characteristics.

The use of the TC socket shown in FIG. 2 for the BGA/LGA hybrid package 10, however, do not establish proper electrical connections with both of the solder balls 13 and the lands 14, because the tips of the contact pins 30 are coplanar on the same plane. When the contact pins 30 prepared for the BGA portion are just in contact with the solder balls 13, the contact pins 30 prepared for the LGA portion are not in contact with the lands 14 as shown in FIG. 3. Although may achieve electrical connections with both of the solder balls 13 and the lands 14, the IC socket shown in FIG. 2 applies different contact pressures on the solder balls 13 and the lands 14. When the BGA/LGA hybrid package 10 is pressed towards the socket body 20 so that the contact pins 30 for the LGA portion are in contact with the lands 14 with proper contact pressure, excessive contact pressure may be applied to the solder balls 14, which may result in undesirable crush of the solder balls 14. When the BGA/LGA hybrid package 10 is pressed so that the contact pins 30 for the BGA portion are in contact with the lands 14 with proper contact pressure, on the other hand, the contact pressure applied to the lands 14 is excessively reduced. The difference in the applied pressure between the solder balls 13 and lands 14 results in different contact impedances, which may making it impossible to conduct appropriate LSI tests.

In the following, preferred embodiments of the present invention will be described in detail. Those skilled in the art will recognize that many alternative embodiments can be accomplished using the teachings of the description of the embodiments and that the invention is not limited to the embodiments illustrated for explanatory purposes.

First Embodiment

Figure 4:
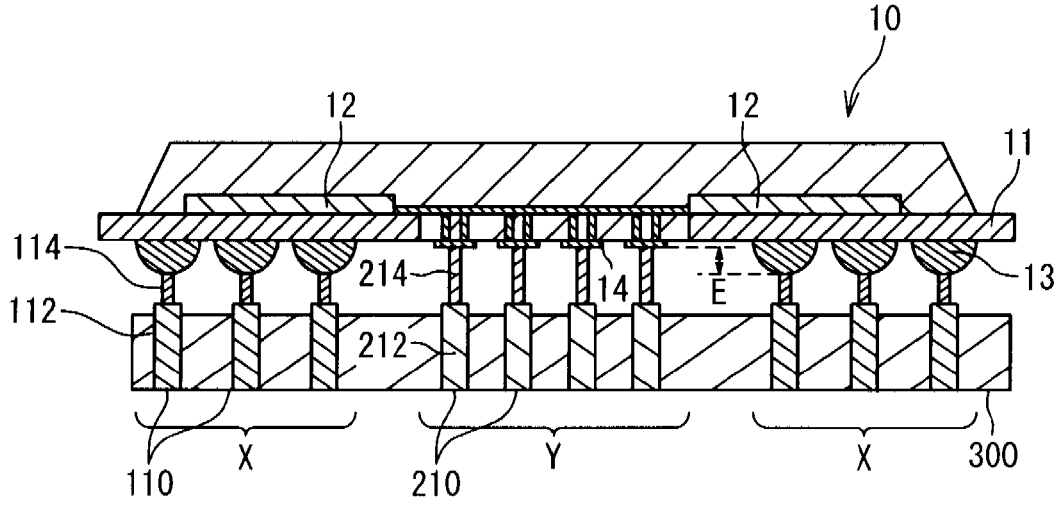
FIG. 4 illustrates an exemplary structure of an IC socket according to a first embodiment of the present invention.

In a first embodiment, as shown in FIG. 4, an IC socket is provided with a socket body 300, first contact pins 110 and second contact pins 210. The first contact pins 110 are spring pins used to establish electrical connections with the solder balls 13, and the second contact pins 210 are spring pins used to establish electrical connections with the lands 14.

The first and second contact pins 110 and 210 are arrayed in accordance with the arrangement of the solder balls 13 and the lands 14 (See FIG. 1B). The first contact pins 110 are positioned opposed to the solder balls 13 and the second contact pins 210 are positioned opposed to the lands 14. The distance between adjacent two of the second contact pins 210 may be smaller than that between adjacent two of the first contact pins 110. The lands 14 are small-sized compared with the solder balls 13, and this allows reducing the distance between adjacent two of the second contact pins 210.

The first contact pins 110 each include a barrel member 112 fixed with the socket body 300, and a plunger member 114 slidably inserted into the barrel member 112. Correspondingly, the second contact pins 210 each include a barrel member 212 fixed with the socket body 300, and a plunger member 214 slidably inserted into the barrel member 212.

When the BGA/LGA hybrid package 10 is mounted on the IC socket according to the first embodiment, as shown in FIG. 4, the distance between the solder balls 13 and the socket body 300 is different from that between the lands 14 and the socket body 300; the difference between these distances is referred to as the terminal height difference E, hereinafter. In the first embodiment, the first contact pins 110 and second contact pins 210 are structured to absorb the terminal height difference E, and to thereby allow the first and second contact pins 110 and 210 to be contacted with the solder balls 13 and the lands 14, respectively, with the same contact pressure. This allows successfully conducting LSI tests.

Figure 5A:
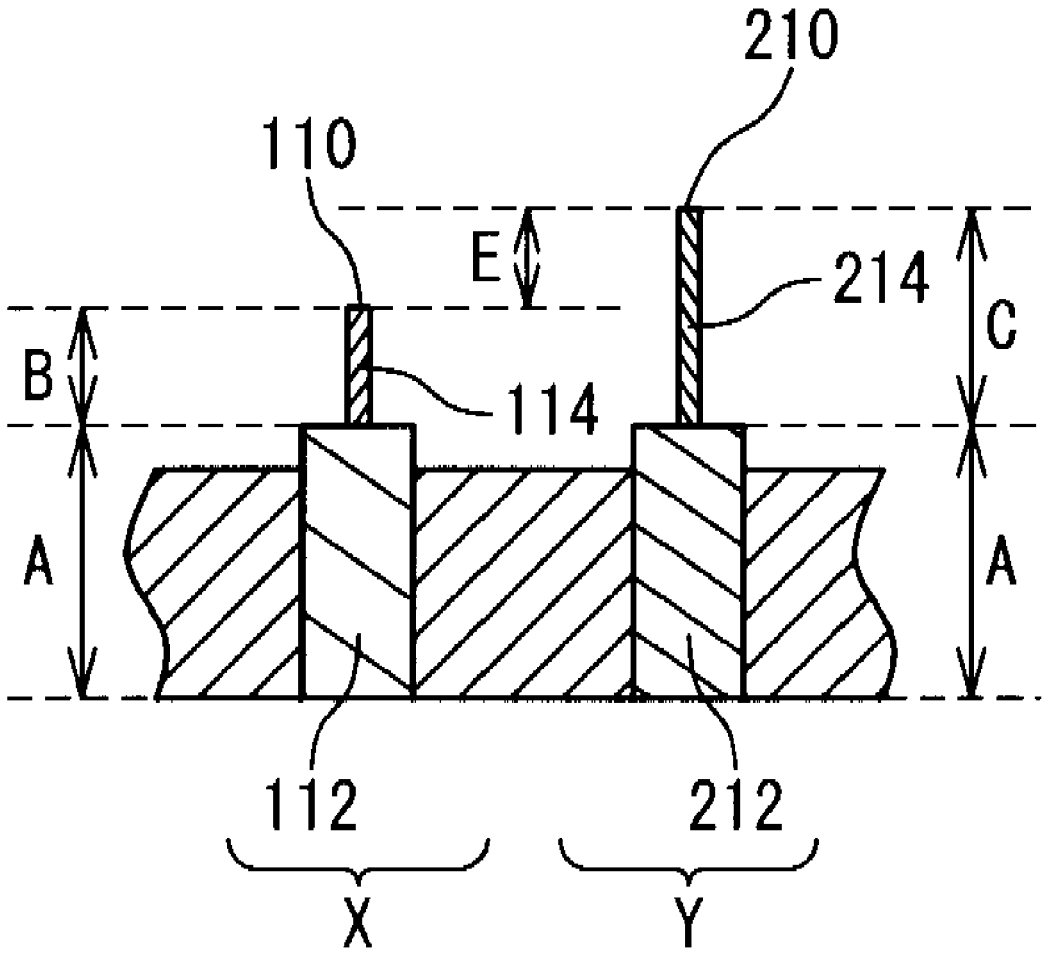
FIG. 5A is an enlarged view of illustrating the structure of the IC socket according to the first embodiment.
Figure 5B:
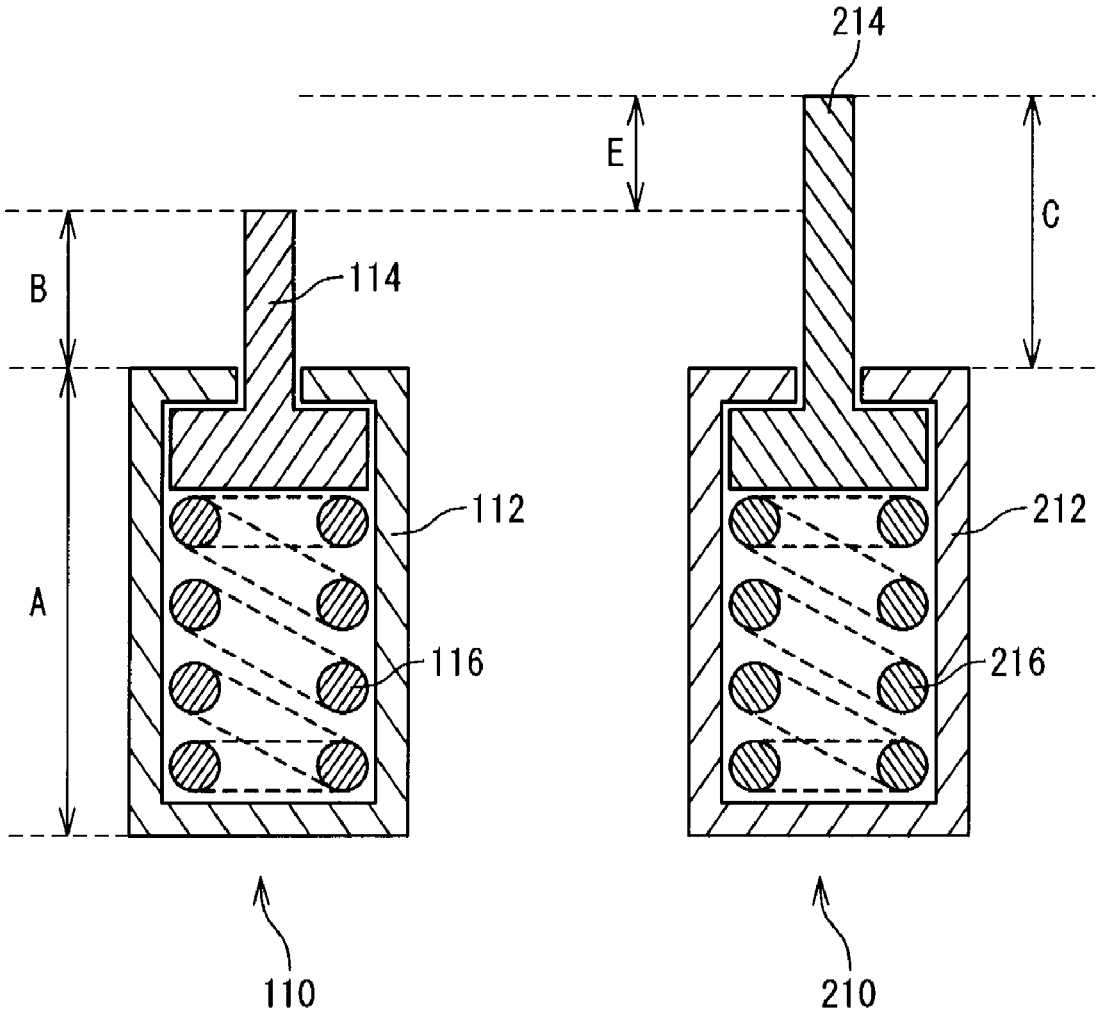
FIG. 5B is a section view illustrating the structure of the contact pins of the IC socket according to the first embodiment.

FIG. 5A is an enlarged view partially illustrating the structure of the IC socket in the portion around the first and second contact pins 110 and 210. As shown in FIG. 5B, each barrel member 112 accommodates a biasing member 116 for biasing the plunger member 114 towards the BGA/LGA hybrid package 10. Correspondingly, each barrel member 212 accommodates the biasing member 216 for biasing the plunger member 214 toward the BGA/LGA hybrid package 10. In one embodiment, the biasing members 116 and 216 may be formed of coil springs or blade springs. In an alternative embodiment, the biasing members 116 and 216 may be formed of elastic material.

Referring back to FIG. 5A, the barrel members 112 and 212 have the same length, while the plunger members 114 and 214 have different lengths. Specifically, the barrel members 112 of the first contact pins 110 have a length of A (hereinafter, referred to as the barrel length A), and the plunger members 114 of the first contact pins 110 protrude from the barrel members 112 with a protruding length of B (hereinafter, referred to as the protruding length B). On the other hand, the barrel members 212 of the second contact pins 210 have the same length as the barrel members 112 of the first contact pins 110 (that is, the barrel length A), while the plunger members 214 protrude from the barrel members 212 with a protruding length of C (hereinafter, referred to as the protruding length C).

In the unused state of the IC socket (that is, the state in which first and second contact pins 110 and 210 are not contacted with BGA/LGA hybrid package 10), the protruding length C of the plunger members 214 is different from the protruding length B of the plunger members 114, so that the distance between the tips of the plunger members 114 and the surface of the socket body 300 is longer by the terminal height difference E than the distance between the tips of the plunger members 214 and the surface of the socket body 300 in the unused state. In this embodiment, the first and second contact pins 110 and 210 are structured so that the difference between the protruding length C of the plunger members 214 and the protruding length B of the plunger members 114 is identical to the terminal height difference E. In other words, the protruding length C of the plunger members 214 is longer than the protruding length B of the plunger members 114 by the terminal height difference E.

Additionally, the biasing members 116 and 216 are structured so that the plunger members 114 and 214 are withdrawn into the barrel members 112 and 212 with the same withdrawal length when the same forces are applied to the plunger members 114 and 214. More specifically, the biasing members 116 and 216 may be formed of springs having the same spring modulus in one embodiment. Alternatively, the biasing members 116 and 216 may be formed of elastic materials with the same elastic coefficient, or the same elastic material.

The structure described above allows the plunger members 114 and 214 to be in contact with the solder balls 13 and the lands 14 of the BGA/LGA hybrid package 10 with substantially the same contact pressure.

Second Embodiment

Figure 6A:
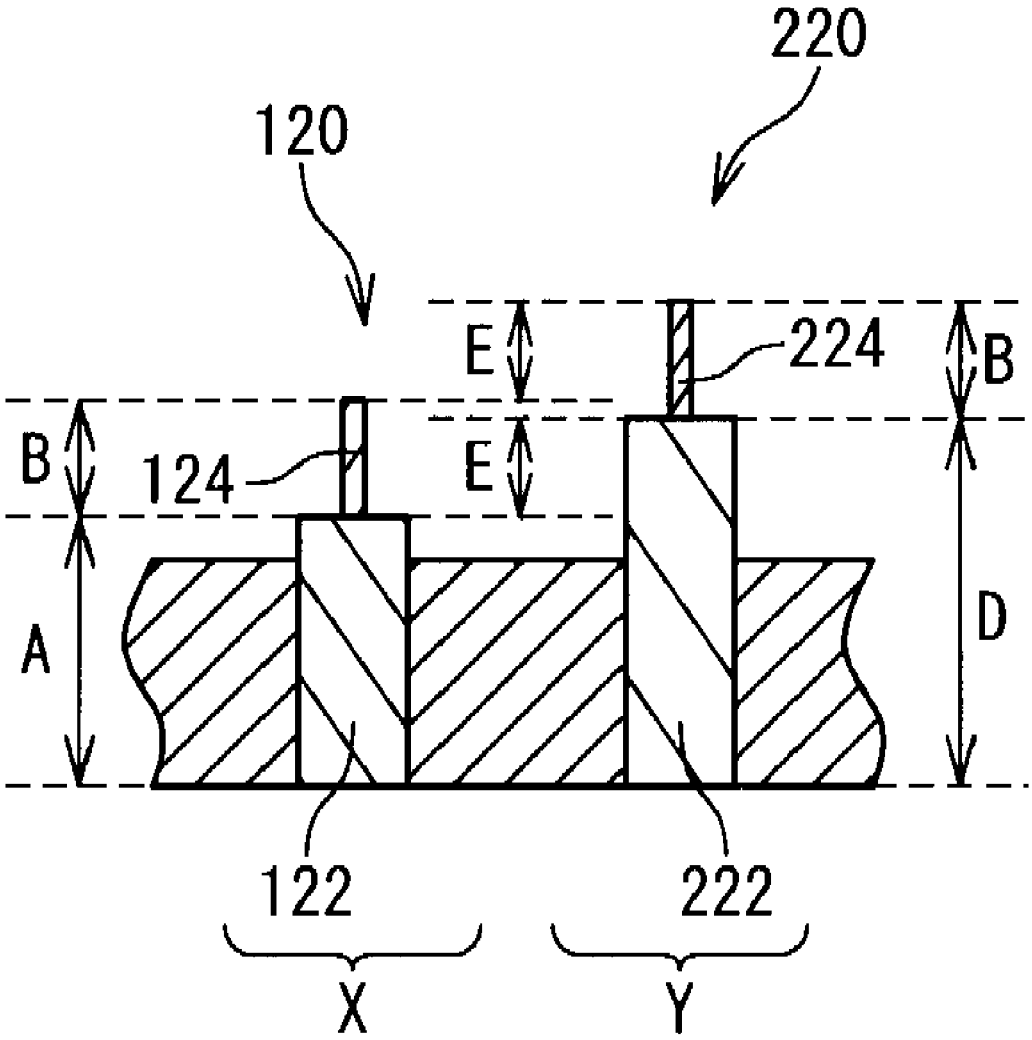
FIG. 6A is an enlarged view of illustrating the structure of the IC socket according to a second embodiment.

FIG. 6A is an enlarge view illustrating the structures of an IC socket according to a second embodiment, especially depicting the structures of first contact pins 120 used for establishing connections with the solder balls 13 and second contact pins 220 used for establishing connections with the lands 14. In the second embodiment, the structure of the second contact pins 220 is modified from that in the first embodiment.

Figure 6B:
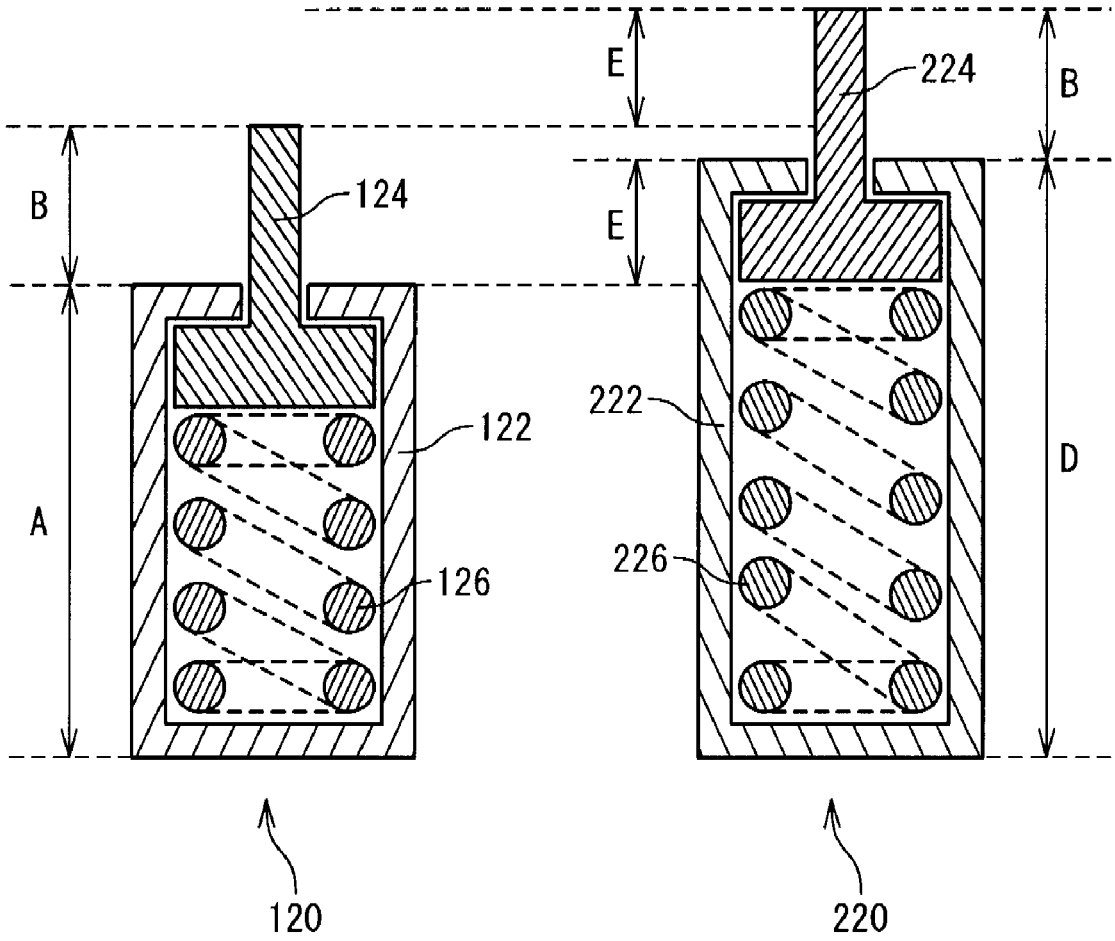
FIG. 6B is a section view illustrating the structure of the contact pins of the IC socket according to the second embodiment.

Specifically, the first contact pins 120 each include a barrel member 122 and a plunger member 124, and the second contact pins 220 each include a barrel member 222 and a plunger member 224. As shown in FIG. 6B, each barrel member 122 accommodates a biasing member 126 for biasing the plunger member 124 towards the BGA/LGA hybrid package 10, and each barrel member 222 accommodates a biasing member 226 for biasing the plunger member 224 towards the BGA/LGA hybrid package 10.

Referring back to FIG. 6A, the barrel members 122 and 222 have different lengths, while the plunger members 124 and 224 have the same length in this embodiment. Specifically, the barrel members 122 of the first contact pins 120 have a length of A (hereinafter, referred to as the barrel length A), and the plunger members 124 protrude from the barrel members 122 with a protruding length of B (hereinafter, referred to as the protruding length B). On the other hand, the barrel members 222 of the second contact pins 220 has a length of D (hereinafter, referred to as the barrel length D), while the plunger members 224 protrude from the barrel members 222 with a protruding length identical to that of the plunger members 124.

It should be noted that the barrel length A of the barrel members 122 of the first contact pins 120 is different from the barrel length D of the barrel members 222 of the second contact pins 220, so that the distance between the tips of the plunger members 214 and the surface of the socket body 300 is longer by the terminal height difference E between the solder balls 13 and the lands 14 than the distance between the tips of the plunger members 224 and the surface of the socket body 300 in the unused state. In this embodiment, the first and second contact pins 110 and 210 are structured so that the difference between the barrel length A of the barrel members 122 and the barrel length D of the barrel members 222 is identical to the terminal height difference E. In other words, the barrel length A of the barrel members 122 is longer by the terminal height difference E than the barrel length D of the barrel members 222.

Additionally, the biasing members 126 and 226 are structured so that the plunger members 124 and 224 are withdrawn into the barrel members 122 and 222 with the same withdrawal length, when the same forces are applied to the plunger members 124 and 224. More specifically, the biasing members 126 and 226 may be formed of springs having the same spring modulus in one embodiment. Alternatively, the biasing members 126 and 226 may be formed of the same elastic material.

The structure described above allows the plunger members 124 and 224 to be in contact with the solder balls 13 and the lands 14 of the BGA/LGA hybrid package 10 with substantially the same contact pressure.

Third Embodiment

Figure 7A:
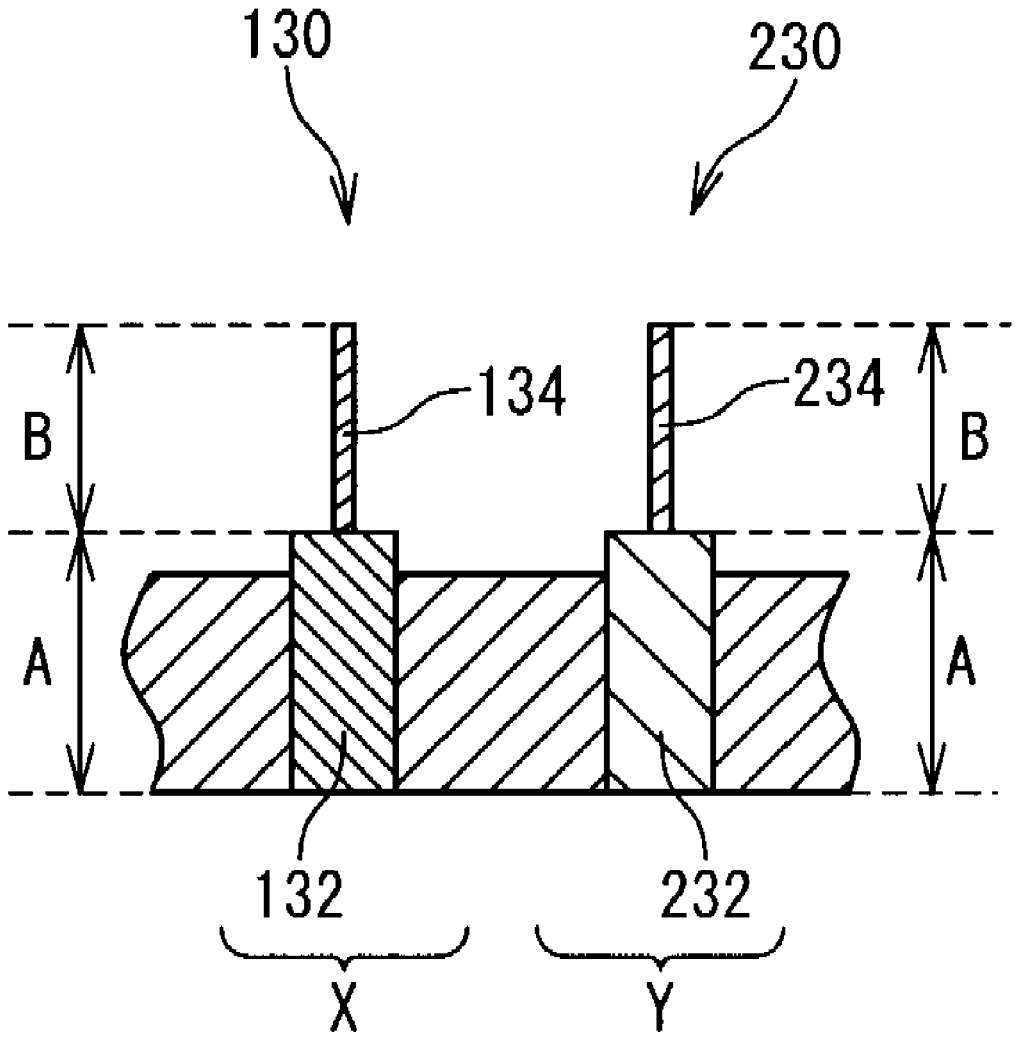
FIG. 7A is an enlarged view of illustrating the structure of the IC socket according to a third embodiment.

FIG. 7A is an enlarge view illustrating the structures of an IC socket according to a third embodiment, especially depicting the structures of first contact pins 130 used for establishing connections with the solder balls 13 and second contact pins 230 used for establishing connections with the lands 14. In the third embodiment, the structures of the first and second contact pins 130 and 230 are modified from those in the first and second embodiments.

Figure 7B:
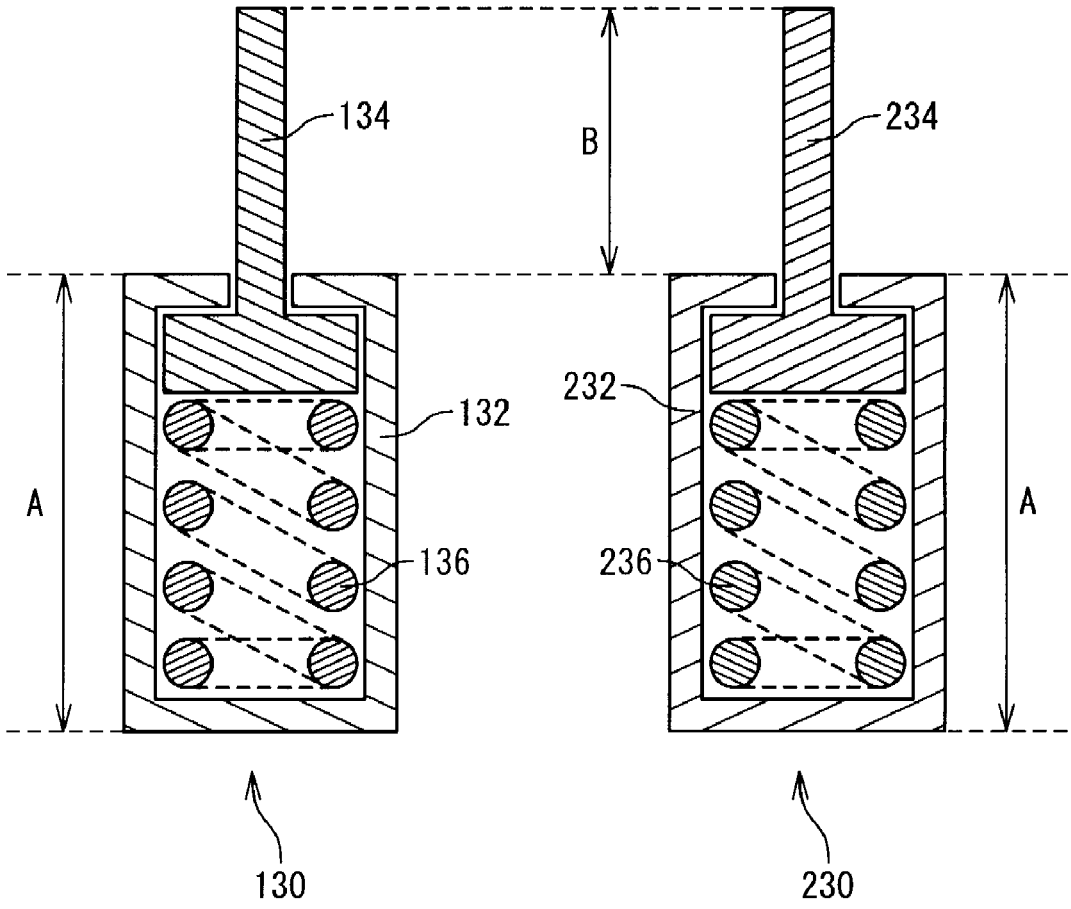
FIG. 7B is a section view illustrating the structure of the contact pins of the IC socket according to the third embodiment.

Specifically, the first contact pins 130 each include a barrel member 132 and a plunger member 134, and the second contact pins 220 each include a barrel member 232 and a plunger member 234. As shown in FIG. 7B, each barrel member 132 accommodates a biasing member 136 for biasing the plunger member 124 towards the BGA/LGA hybrid package 10, and each barrel member 232 accommodates a biasing member 236 for biasing the plunger member 224 towards the BGA/LGA hybrid package 10.

Referring back to FIG. 7A, the barrel members 132 and 232 have the same barrel length of A, while the plunger members 134 and 234 protrude from the barrel members 132 and 232 with the same protruding length of B in the unused state of the IC socket (that is, the state in which first and second contact pins 130 and 230 are not contacted with BGA/LGA hybrid package 10).

In this embodiment, the biasing members 136 and 236 are configured to have different elastic characteristics. The biasing members 136 and 236 are structured so that the plunger members 134 and 234 are respectively withdrawn into the barrel members 132 and 232 with different withdrawal lengths, when the same forces are applied to the respective plunger members 134 and 234, respectively. Preferably, the biasing members 116 and 216 may be formed of springs having different spring moduli in one embodiment. The use of springs, such as coil springs and blade springs, is preferable in terms of easiness of adjustment of the biasing forces applied to the plunger members 134 and 234. Alternatively, the biasing members 116 and 216 may be formed of elastic materials with different elastic coefficients.

Figure 8:
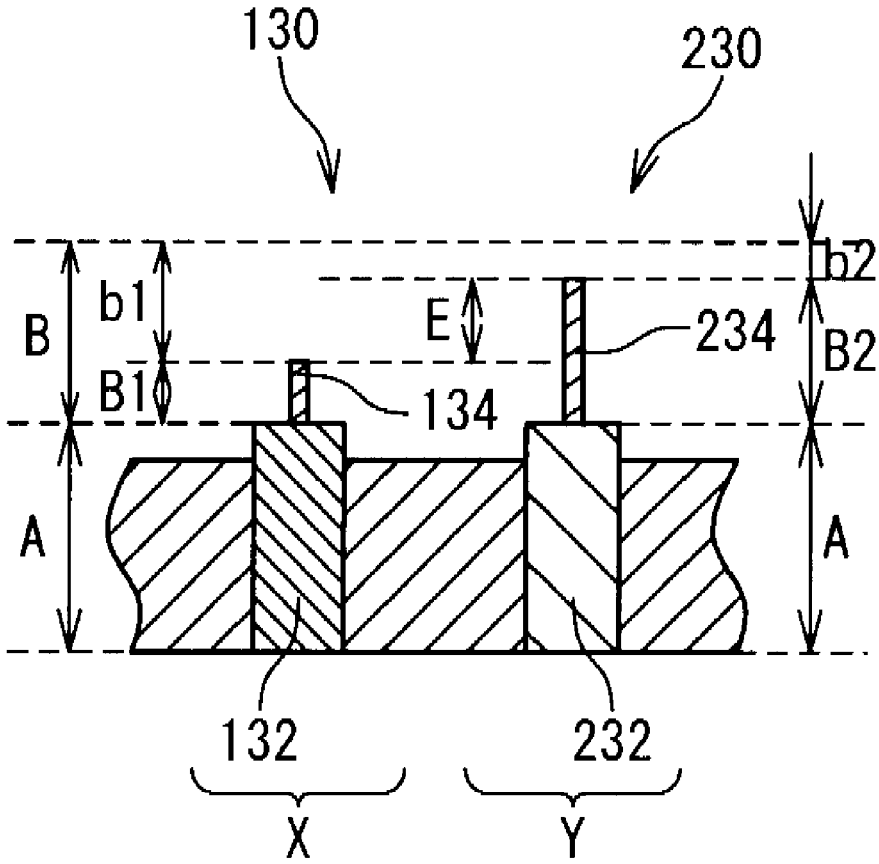
FIG. 8 illustrates the states of the plunger members in the third embodiment, when the same forces are applied to the plunger members.

More specifically, applying the same forces to the plunger members 134 and 234 causes different changes in the protruding lengths of the plunger members 134 and 234 from the barrel members 132 and 232, as shown in FIG. 8. When forces of the same certain strength are commonly applied to the plunger members 134 and 234, the plunger members 134 are withdrawn into the barrel member 132 with a withdrawn length of b1 to reduce the effective protruding length of the plunger members 134 down to B1, while the plunger members 234 are withdrawn into the barrel member 232 with a withdrawn length of b2 to reduce the effective protruding length of the plunger members 234 down to B2.

When the IC socket according to the third embodiment is attached with the BGA/LGA hybrid package 10 to establish electrical connections, the BGA/LGA hybrid package 10 is pressed with a predetermined pressure so that the difference between the effective protruding lengths B1 and B2 is identical to the terminal height differences E between the solder balls 13 and the lands 14. In other words, the BGA/LGA hybrid package 10 is pressed so that the withdrawn length of the plunger members 134 into the barrel members 132 is larger than that of the withdrawn length of the plunger members 234 into the barrel members 232 by the terminal height difference E between the solder balls 13 and the lands 14. This allows the plunger members 124 and 224 to be in contact with the solder balls 13 and the lands 14 of the BGA/LGA hybrid package 10 with substantially the same contact pressure.

As described above, the above-described IC socket structures according to the first to third embodiments allows establishing electrical connections with solder balls and lands of a BGA/LGA hybrid package with substantially the same contact pressure, avoiding crush of solder balls potentially caused by excessive pressure. This is effective for conducting a proper IC test.

It is apparent that the present invention is not limited to the above-described embodiments, but may be modified and changed without departing from the scope of the invention.

What is claimed is:

1. An IC socket comprising:

a first contact pin configured for connection with a first terminal of a semiconductor package;

a second contact pin configured for connection with a second terminal of a semiconductor package for testing the semiconductor package;

a socket body supporting said first and second contact pins;

said first contact pin comprises:

a first barrel member fixed to said socket body; and a first plunger member inserted into said first barrel member, said first plunger member protruding from said first barrel member;

said second contact pin comprises:

a second barrel member fixed to said socket body; and a second plunger member inserted into said second barrel member, said second plunger member protruding from said second barrel member, wherein a height of a tip of said second plunger, member is greater than a height of a tip of said first plunger member.

2. The IC socket according to claim 1, wherein said distance between said tip of said second plunger member and said face of said socket body is longer than said distance between said tip of said first plunger member and said face of said socket body by a predetermined height difference.

3. The IC socket according to claim 1, wherein said first and second barrel members have the same height, and a protruding length of said second plunger member from said second barrel member is longer than that of said first plunger member from said first barrel member.

4. The IC socket according to claim 1, wherein said first and second plunger members respectively protrude from said first and second barrel members with the same protruding length; and a height of said second barrel member is greater than a height of said first barrel member.

5. The IC socket according to claim 1, wherein said first contact pin further includes a first biasing member for biasing <said first plunger member away from said socket body, said second contact pin further includes a second biasing member for biasing said second plunger member away from said socket body, and said first and second biasing members are structured so that said first and second plunger members are respectively withdrawn into said first and second barrel members with the same withdrawal length when the same forces are applied to the said first and second plunger members.

6. The IC socket according to claim 1, wherein an array of said first contact pins are provided for said socket body, an array of said second contact pins are provided for said socket body, and a distance between adjacent two of said first contact pins is larger than that between adjacent two of said second contact pins.

7. The IC socket according to claim 1, wherein an array of said second contact pins are provided for said socket body, and a plurality of said first contact pins are arrayed to surround said array of said second contact pins.

8. The IC socket according to claim 1, wherein said first terminal is a solder ball, and said second terminal is a land.

9. A structure comprising:

a semiconductor package including:

a first terminal; and a second terminal, said first and second terminals having different heights from a mount face of said semiconductor package;

said second terminal configured for testing said semiconductor package;

an IC socket comprising:

a first contact pin that establishes a connection with the first terminal;

a second contact pin that establishes a connection with the second terminal;

said first contact pin comprises:

a first barrel member fixed to said socket body; and a first plunger member inserted into said first barrel member, said first plunger member protruding from said first barrel member to contact said first terminal;

said second contact pin comprises:

a second barrel member fixed to said socket body; and a second plunger member inserted into said second barrel member, said second plunger member protruding from said second barrel member to contact said second terminal, wherein a height of said second plunger member is greater that a height of said first plunger member by a height difference between said first and second terminals.

10. The structure according to claim 9, wherein a contact pressure between said first contact pin and said first terminal is substantially equal to a contact pressure between said second contact pin and said second terminal.

* * * * *